US006345736B1

(12) United States Patent
Berry et al.

(10) Patent No.: US 6,345,736 B1
(45) Date of Patent: Feb. 12, 2002

(54) LIQUID DISPENSING DEVICE

(76) Inventors: Jerry R. Berry; Ronnie V. Chaplin, both of 602 NW. Front St., Vivian, LA (US) 71082

( * ) Notice: Subject to any disclaimer, the term of this patent is extended or adjusted under 35 U.S.C. 154(b) by 0 days.

(21) Appl. No.: 09/714,922

(22) Filed: Nov. 17, 2000

(51) Int. Cl.[7] ..... B65D 37/00
(52) U.S. Cl. ..... 222/211; 141/364
(58) Field of Search ..... 222/181, 181.2, 222/181.3, 206, 207, 214, 321.7; 141/364, 365, 366

(56) References Cited

U.S. PATENT DOCUMENTS 1,392,601 A * 10/1921 Rose ..... 222/181.2
1,560,184 A 11/1925 McLean et al.
2,619,914 A * 12/1952 Dobkin ..... 222/321.7
3,653,554 A 4/1972 Turben
4,085,866 A * 4/1978 Fekl ..... 222/181
4,085,867 A 4/1978 Heller
4,345,627 A * 8/1982 Cassia ..... 141/364
5,067,680 A 11/1991 Miller
5,209,565 A * 5/1993 Goncalves ..... 141/364
D360,094 S 7/1995 Andrus et al.
5,638,989 A 6/1997 Ophardt et al.
5,810,205 A 9/1998 Kohen

* cited by examiner

*Primary Examiner*—David A. Scherbel
*Assistant Examiner*—Thach H Bui

(57) ABSTRACT

A liquid dispensing device for effectively using all of the liquid placed in the dispensing device. The liquid dispensing device includes a main member that has at least one holding chamber that is designed for containing a liquid. Each holding chamber has an associated refill connection portion. Each refill connection portion is designed to engage a container that contains a liquid. Each refill connection portion extends from a top end of the main member adjacent an associated holding chamber. Moreover, each refill connection portion has a connection bore that allows liquid to enter into an associated holding chamber. Each holding chamber is further in fluid communication with an associated pumping member that is coupled to a bottom end of the main member. Each pumping member is designed for pumping out the liquid in an associated holding chamber.

17 Claims, 3 Drawing Sheets

LIQUID DISPENSING DEVICE

BACKGROUND OF THE INVENTION

1. Field of the Invention

The present invention relates to liquid dispensing devices and more particularly pertains to a new liquid dispensing device for effectively using all of the liquid placed in the dispensing device.

2. Description, of the Prior Art

The use of liquid dispensing devices is known in the prior art. More specifically, liquid dispensing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,085,867; 5,067,680; 3,653,554; 5,638,989; Des. 360,094; 1,560,180; and Magazine ad: Title of Source—MILES KIMBALL, Date of Source—1998, Page of source—36, Product Name—"Triple Dispenser".

While these devices fulfill their respective, particular objectives and requirements, the aforementioned patents do not disclose a new liquid dispensing device. The inventive device includes a main member that has at least one holding chamber that is designed for containing a liquid. Each holding chamber has an associated refill connection portion. Each refill connection portion is designed to engage a container that contains a liquid. Each refill connection portion extends from a top end of the main member adjacent an associated holding chamber. Moreover, each refill connection portion has a connection bore that allows liquid to enter into an associated holding chamber. Each holding chamber is further in fluid communication with an associated pumping member that is coupled to a bottom end of the main member. Each pumping member is designed for pumping out the liquid in an associated holding chamber.

In these respects, the liquid dispensing device according to the present invention substantially departs from the conventional concepts and designs of the prior art, and in so doing provides an apparatus primarily developed for the purpose of effectively using all of the liquid placed in the dispensing device.

SUMMARY OF THE INVENTION

In view of the foregoing disadvantages inherent in the known types of liquid dispensing devices now present in the prior art, the present invention provides a new liquid dispensing device construction wherein the same can be utilized for effectively using all of the liquid placed in the dispensing device.

The general purpose of the present invention, which will be described subsequently in greater detail, is to provide a new liquid dispensing device apparatus and method which has many of the advantages of the liquid dispensing devices mentioned heretofore and many novel features that result in a new liquid dispensing device which is not anticipated, rendered obvious, suggested, or even implied by any of the prior art liquid dispensing devices, either alone or in any combination thereof.

To attain this, the present invention generally comprises a main member that has at least one holding chamber that is designed for containing a liquid. Each holding chamber has an associated refill connection portion. Each refill connection portion is designed to engage a container that contains a liquid. Each refill connection portion extends from a top end of the main member adjacent an associated holding chamber. Moreover, each refill connection portion has a connection bore that allows liquid to enter into an associated holding chamber. Each holding chamber is further in fluid communication with an associated pumping member that is coupled to a bottom end of the main member. Each pumping member is designed for pumping out the liquid in an associated holding chamber.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new liquid dispensing device apparatus and method which has many of the advantages of the liquid dispensing devices mentioned heretofore and many novel features that result in a new liquid dispensing device which is not anticipated, rendered obvious, suggested, or even implied by any of the prior art liquid dispensing devices, either alone or in any combination thereof.

It is another object of the present invention to provide a new liquid dispensing device that may be easily and efficiently manufactured and marketed.

It is a further object of the present invention to provide a new liquid dispensing device that is of a durable and reliable construction.

An even further object of the present invention is to provide a new liquid dispensing device which is susceptible of a low cost of manufacture with regard to both materials and labor, and which accordingly is then susceptible of low prices of sale to the consuming public, thereby making such liquid dispensing device economically available to the buying public.

Still yet another object of the present invention is to provide a new liquid dispensing device which provides in the apparatuses and methods of the prior art some of the advantages thereof, while simultaneously overcoming some of the disadvantages normally associated therewith.

Still another object of the present invention is to provide a new liquid dispensing device for effectively using all of the liquid placed in the dispensing device.

Yet another object of the present invention is to provide a new liquid dispensing device which includes a main member that has at least one holding chamber that is designed for containing a liquid. Each holding chamber has an associated refill connection portion. Each refill connection portion is designed to engage a container that contains a liquid. Each refill connection portion extends from a top end of the main member adjacent an associated holding chamber. Moreover, each refill connection portion has a connection bore that allows liquid to enter into an associated holding chamber. Each holding chamber is further in fluid communication with an associated pumping member that is coupled to a bottom end of the main member. Each pumping member is designed for pumping out the liquid in an associated holding chamber.

Still yet another object of the present invention is to provide a new liquid dispensing device that provides organization of liquid products.

Even still another object of the present invention is to provide a new liquid dispensing device that is easy to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
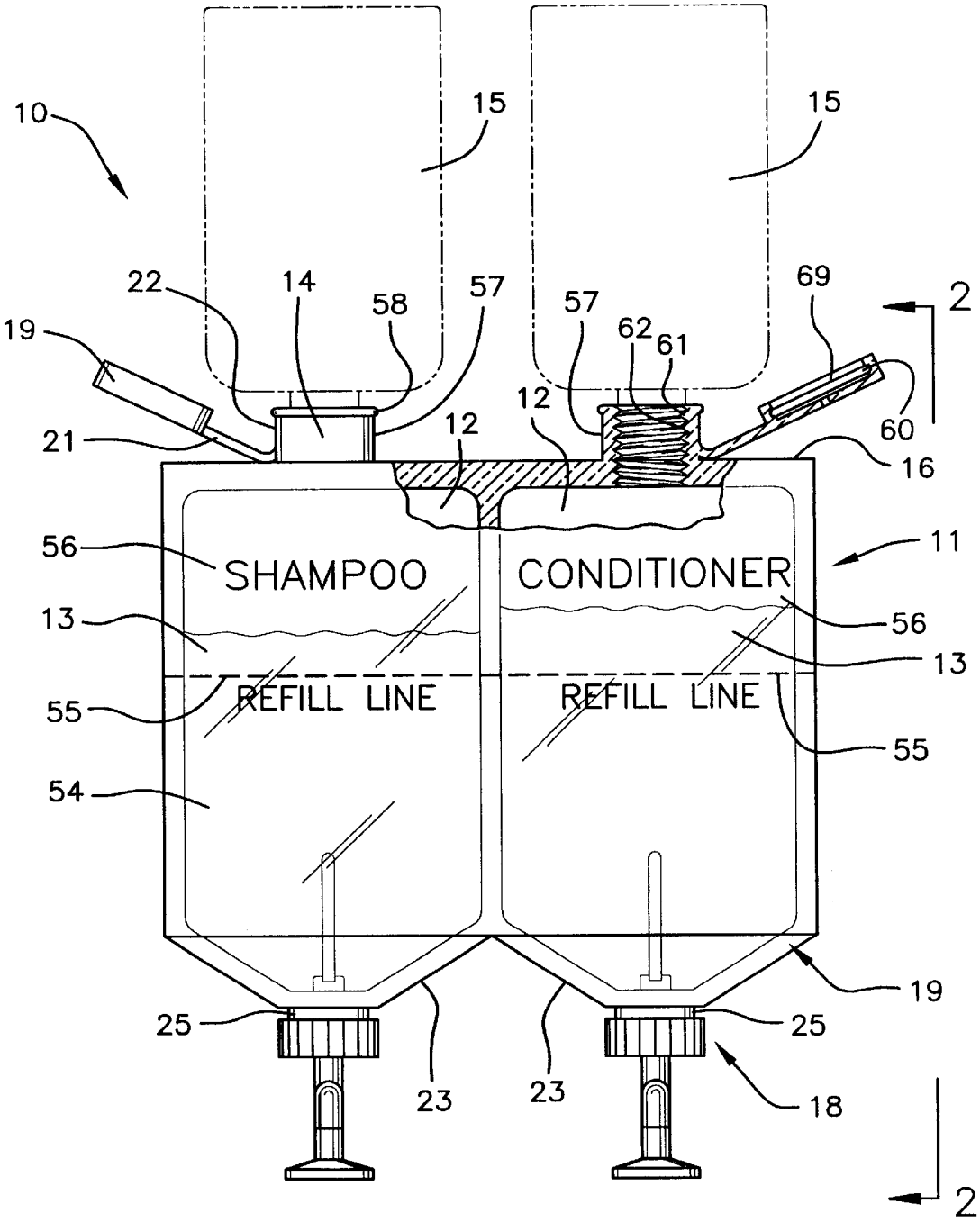
FIG. 1 is a schematic front view of a new liquid dispensing device according to the present invention.
Figure 2:
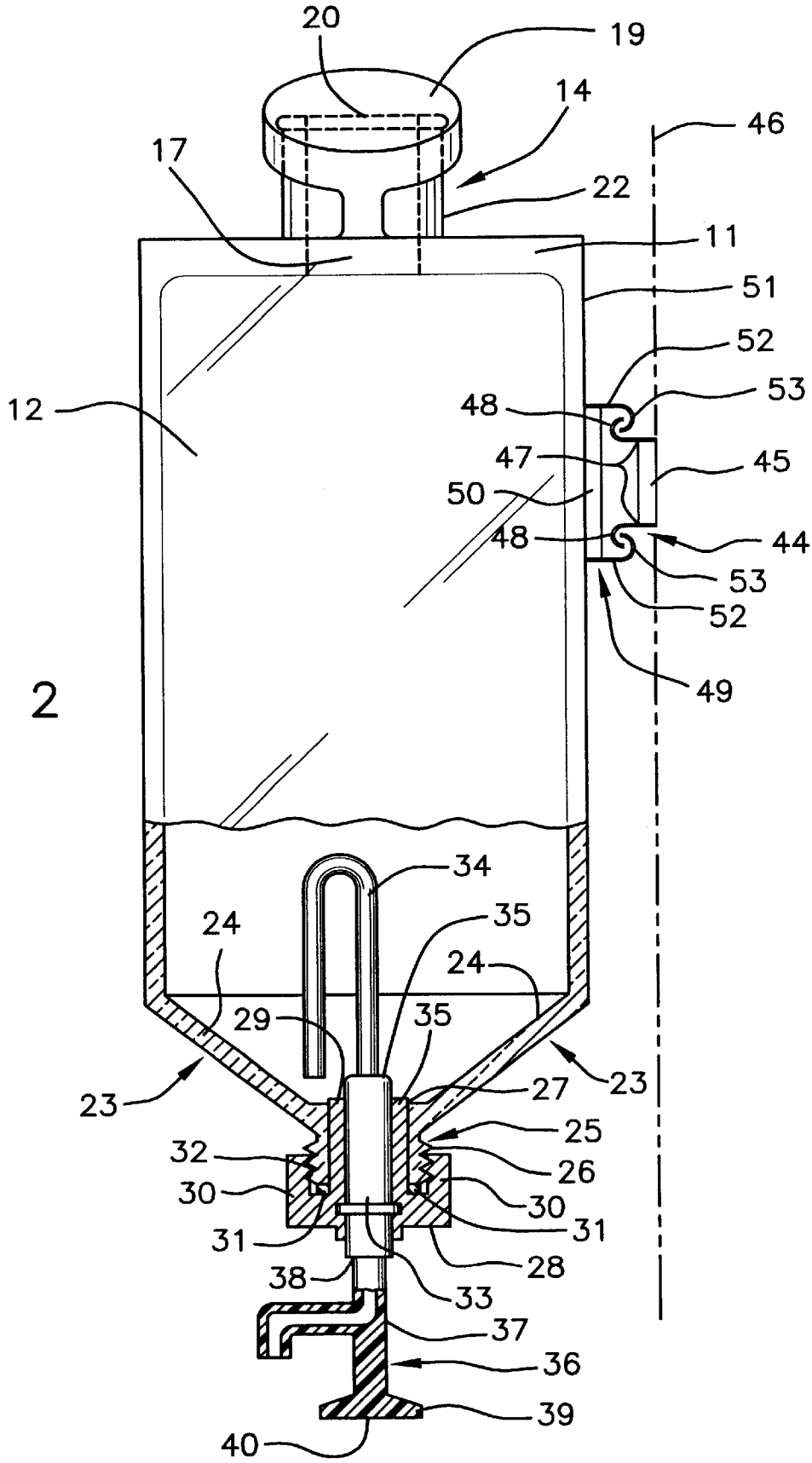
FIG. 2 is a.schematic cross-sectional side view of the present invention.
Figure 3:
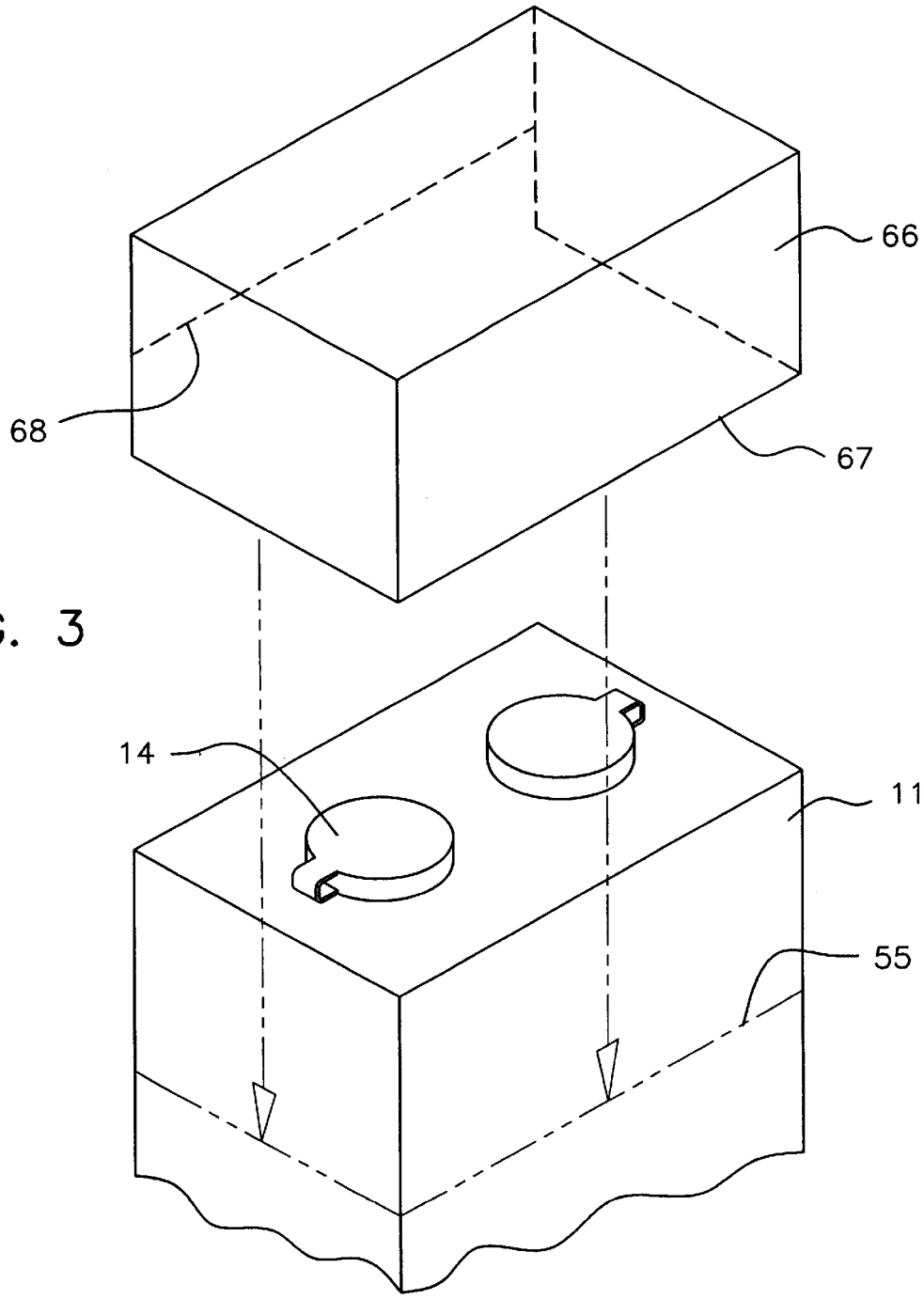
FIG. 3 is a perspective view of the present invention including a removable cover.

With reference now to the drawings, and in particular to FIGS. 1 through 3 thereof, a new liquid dispensing device embodying the principles and concepts of the present invention and generally designated by the reference numeral 10 will be described.

As best illustrated in FIGS. 1 through 3, the liquid dispensing device 10 generally comprises a main member 11 that has at least one holding chamber 12 that is designed for containing a liquid 13. Each holding chamber 12 has an associated refill connection portion 14. Each refill connection portion 14 is designed to engage a container 15 that contains a liquid 13. Each refill connection portion 14 extends from a top end 16 of the main member 11 adjacent an associated holding chamber 12. Moreover, each refill connection portion 14 has a connection bore 17 that allows liquid 13 to enter into an associated holding chamber 12. Each holding chamber 12 is further in fluid communication with an associated pumping member 18 that is coupled to a bottom end 63 of the main member 11. Each pumping member 18 is designed for pumping out the liquid 13 in an associated holding chamber 12.

In closer detail, each connection bore 17 of the refill connection portion 14 has internal threads 61 adapted for engaging external threads 62 on the container 15 that contains liquids 13. Thus, the container 15 is threadably coupled to the refill connection portion 14 while the liquid 13 is being transferred to an associated holding chamber 12.

Caps 19 are used to prevent debris from entering the connection bores 17 when the connection bores are not being used to transfer liquid 13 into an associated holding chamber 12. The caps are designed to selectively cover an opening 20 of an associated connection bore 17. Each refill connection portion 14 has a distal cap connecting end 57. The distal cap connecting end 57 has an extending lip 58. Each cap 19 is malleable and has a well 59. Each well 59 has an inner channel 60 that is designed to selectively engage the lip 58 of the distal cap connecting end 57. Thus the cap 19 may be snapped onto the refill connection portion 14.

In addition, a malleable connecting strap 21 is used for preventing the loss of the cap 19. The connecting strap 21 couples the cap 19 to an external surface 22 of the refill connection portion 14.

Each holding chamber 12 has an associated generally frusto-conical bottom portion 23. The bottom portion 23 extends from the bottom end 63 of the main member 11 adjacent an associated holding chamber 12. Each bottom portion 23 has an inner surface 24 that is in fluid communication with an associated holding chamber 12.

A generally cylindrical pump connection portion 25 extends from each bottom portion 23. Each pump connection portion 25 has external threads 26. Each said pump connection portion 25 further has a bore 27 therein. The bore 27 is in fluid communication with the inner surface 24 of the bottom portion 23.

The pumping member 18 includes a main connecting portion 28 for coupling the pumping member 18 to the pump connection portion 25. The main connecting portion 28 has a generally cylindrical inside portion 29 that is designed to be received in the bore 27 in the pump connection portion 25. The main connecting portion 28 further has a generally cylindrical outside portion 30.

The main connecting portion 28 of the pump member 18 also has a generally cylindrical channel 31. The channel 31 is positioned between the outside portion 30 and the inside portion 32. The channel 31 has channel threads 32 that are designed to engage the external threads 26 on the pump connection portion 25. The main connecting portion 28 is threadably coupled to the pump connection portion 25. Thus the inside portion 29 of the main connecting portion 28 is received in the bore 27 in the pump connection portion 25.

The pumping member 18 has a pump portion 33 for pumping liquid 13. The pump portion 33 is encased in the main connecting portion 28 of the pumping member 18. A generally U-shaped pickup tube 34 is used for receiving the liquid 13. The pickup tube 34 is received in the holding chamber 12. The pickup tube 34 is operationally coupled to a first end 35 of the pump portion 33.

The pumping member 18 also has an engagement portion 36 for activating the pump portion 33. The engagement portion 36 has a shaft 37 that extends from a second end 38 of the pump portion 33. The engagement portion 36 further has a generally disk shaped distal engagement end 39. The distal engagement end 39 further has an engagement surface 40.

The pumping member 18 further has a spout portion 41 that extends out from a medial portion 42 of the engagement portion 36. The spout portion 41 has a spout bore 43 that is in operational communication with the pump portion 33. When the engagement surface 40 of the engagement portion 36 is pushed towards the pump portion 33, the pump portion 33 is activated. When the pump portion is activated, liquid 13 in the holding chamber 12 is pumped through the pickup tube 34 and out of the spout bore 43 in the spout portion 41. The spout bore 43 is positioned so that the liquid 13 will fall into the hand of the user activating the pump portion 33.

The liquid dispensing device 10 has a first bracket 44. The first bracket 44 has a surface connecting portion 45. The surface connecting portion 45 is designed to couple to a vertical surface 46. The first bracket 44 further has a pair of first arms 47. The first arms 47 extend out from opposite sides of the surface connecting portion 45 along a length of the surface connecting portion 45. The first arms 47 have distal first ends 48 that curve away from the surface connecting portion 45.

The liquid dispensing device 10 also has a second bracket 49. The second bracket 49 is designed for engaging the first bracket 44. The second bracket 49 has a main connecting portion 50. The main connecting portion 50 is coupled to a back side 51 of the main member 11. The second bracket 49 has a pair of second arms 52. The second arms 52 extend out from opposite sides of the main connecting portion 50 along a length of the main connecting portion 50. The second arms 52 have distal second ends 53 that curve toward the main connecting portion 50. The distal second ends 53 are designed to slidably engage the distal first ends 48 of the first bracket 44. The first bracket 44 is slidably coupled to the second bracket 49. Thus the main member 11 is coupled to the vertical surface 46.

In addition, the main member 11 has a transparent front side 54 for allowing viewing of the level of the liquid 13 in each holding chamber 12. The front side 54 of the main member 11 also has refill indicia 55 thereon. The refill indicia 54 indicates when the liquid 13 in an associated holding chamber 12 is low. Moreover, the front side 54 of the main member 11 has identifying indicia 56 thereon. The identifying indicia 56 indicates the type of liquid 13 in an associated holding chamber 12.

In use, the liquid dispensing device 10 is mounted to a vertical surface 46 by the first and second brackets 44, 49. Each holding chamber 12 is then filled with a liquid 13 like shampoo, conditioner or soap. When a user desires the liquid 13, the user simply pushes the engagement surface 40 of the engagement portion 36 of the pump member 18 towards the pump portion 33 of the pump member 18. This action activates the pump portion 33 thereby causing the liquid 13 to be pumped out of the holding chamber 12 through the pickup tube 34 and out of the spout portion 41 into the hand of the user.

In an embodiment, a cover 66 is provided. The cover 66 is generally rectangular and has an open bottom for receiving the upper portion of the main member 11. Ideally, the cover has a front bottom edge 67 that substantially aligns with the refill line of the holding chamber. Thus, visual determination of the need to refill the holding chamber is not obscured when the cover is positioned on the main member. The cover 66 also preferably has a back face that is shorter than a front face of the cover such that a back bottom edge 68 of the cover 66 is positioned above the main connecting portion 50 when the cover is positioned on the main member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A liquid dispensing device comprising:

a main member;

said main member having at least one holding chamber adapted for containing a liquid;

a refill connection portion for each said holding chamber, said refill connection portion being adapted to engage a container that contains a liquid, said refill connection portion extending from a top end of said main member adjacent said associated holding chamber;

each said refill connection portion having a connection bore for allowing said liquid to enter into said associated holding chamber, each said connection bore extending into said associated holding chamber;

a pumping member for each said holding chamber, said pumping member being for pumping out said liquid in said associated holding chamber, each said pumping member being in fluid communication with said liquid in said associated holding chamber, each said holding pump further being coupled to a bottom end of said main member; and a cap for preventing debris from entering said connection bore when said connection bore is not being used to transfer liquid into said associated holding chamber, said cap being adapted to selectively cover an opening to said connection bore.

2. The liquid dispensing device of claim 1 further comprising:

each said connection bore having internal threads adapted for engaging external threads on said container that contains liquids wherein said container is threadably coupled to said refill connection portion while said liquid is being transferred to said associated holding chamber.

3. The liquid dispensing device of claim 1 further comprising:

said refill connection portion having a distal cap connecting end, said distal cap connecting end having an extending lip; and said cap being malleable, said cap further having a well, said well having an inner channel adapted to selectively engage said lip of said distal cap connecting end wherein said cap may be snapped onto said refill connection portion.

4. The liquid dispensing device of claim 1 further comprising:

a malleable connecting strap for preventing the loss of said cap, said connecting strap coupling said cap to an external surface of said refill connection portion.

5. The liquid dispensing device of claim 1 further comprising:

each said holding chamber having an associated generally frusto-conical bottom portion, said bottom portion extending from said bottom end of said main member adjacent said associated holding chamber, each of said bottom portion having an inner surface in fluid communication with said associated holding chamber.

6. The liquid dispensing device of claim 5 further comprising:

a generally cylindrical pump connection portion extending from each said bottom portion, each said pump connection portion having external threads, each said pump connecting portion further having a bore therein, said bore being in fluid communication with said inner surface of said bottom portion.

7. The liquid dispensing device of claim 6, said pumping member further comprising:

a main connecting portion for coupling said pumping member to said pump connection portion, said main connecting portion having a generally cylindrical inside portion adapted to be received in said bore in said pump connection portion, said main connecting portion further having a generally cylindrical outside portion;

said main connecting portion having also having a generally cylindrical channel, said channel being positioned between said outside portion and said inside portion, said channel having channel threads adapted to engage said external threads on said pump connection portion, said main connecting portion being threadably coupled to said pump connection portion wherein said inside portion of said main connecting portion is received in said bore in said pump connection portion;

a pump portion for pumping liquid, said pump portion being encased in said main connecting portion of said pumping member;

a pickup tube for receiving liquid, said pickup tube being received in said holding chamber, said pickup tube being operationally coupled to a first end of said pump portion;

an engagement portion for activating said pump portion, said engagement portion having a shaft extending from a second end of said pump portion, said engagement portion further having a distal engagement end, said distal engagement end further having an engagement surface, said pump portion being activated when said engagement surface of said engagement portion is pushed towards said pump portion;

a spout portion extending out from a medial portion of said engagement portion, said spout portion having a spout bore in operational communication with said pump portion, said spout bore being positioned so that said liquid will fall into a hand of a user when said pump portion is activated by said hand of said user.

8. The liquid dispensing device of claim 7 wherein said pickup tube is generally U-shaped.

9. The liquid dispensing device of claim 7 wherein said distal engagement end is generally disk shaped.

10. The liquid dispensing device of claim 1 further comprising:

a first bracket, said first bracket having a surface connecting portion, said surface connecting portion being adapted to couple to a vertical surface, said first bracket further having a pair of first arms, said first arms extending out from opposite sides of said surface connecting portion along a length of said surface connecting portion, said first arms having distal first ends that curve away from said surface connecting portion; and a second bracket adapted for engaging said first bracket, said second bracket having a main connecting portion, said main connecting portion being coupled to a back side of said main member, said second bracket having a pair of second arms, said second arms extending out from opposite sides of said main connecting portion along a length of said main connecting portion, said second arms having distal second ends that curve toward said main connecting portion, said distal second ends being adapted to slidably engage said distal first ends of said first bracket, said first bracket being slidably coupled to said second bracket wherein said main member is coupled to said vertical surface.

11. The liquid dispensing device of claim 1 further comprising:

said main member having a transparent front side for allowing viewing of the level of said liquid in each said holding chamber.

12. The liquid dispensing device of claim 11 further comprising:

said front side of said main member having refill indicia thereon, said refill indicia indicating when said liquid in an associated holding chamber is low.

13. The liquid dispensing device of claim 1 further comprising:

said front side of said main member having identifying indicia thereon, said identifying indicia indicating the type of liquid in an associated holding chamber.

14. A liquid dispensing device comprising:

a main member having at least one holding chamber adapted for containing a liquid;

a refill connection portion for each said holding chamber, said refill connection portion being adapted to engage a container that contains a liquid, said refill connection portion extending from a top end of said main member adjacent said associated holding chamber, each said refill connection portion having a connection bore for allowing said liquid to enter into said associated holding chamber, each said connection bore extending into said associated holding chamber;

a pumping member for each said holding chamber, said pumping member being in fluid communication with said associated holding chamber for pumping liquid out of said associated holding chamber, each said holding pump being coupled to a bottom end of said main member;

wherein each said holding chamber has an associated generally frusto-conical bottom portion extending from said bottom end of said main member adjacent said associated holding chamber, each of said bottom portions having an inner surface in fluid communication with said associated holding chamber;

wherein a generally cylindrical pump connection portion extends from each said bottom portion, each said pump connection portion having external threads, each said pump connecting portion further having a bore therein, said bore being in fluid communication with said inner surface of said bottom portion;

wherein said pumping member further comprises:

a main connecting portion for coupling said pumping member to said pump connection portion, said main connecting portion having a generally cylindrical inside portion adapted to be received in said bore in said pump connection portion, said main connecting portion further having a generally cylindrical outside portion;

said main connecting portion having also having a generally cylindrical channel, said channel being positioned between said outside portion and said inside portion, said channel having channel threads adapted to engage said external threads on said pump connection portion, said main connecting portion being threadably coupled to said pump connection portion wherein said inside portion of said main connecting portion is received in said bore in said pump connection portion;

a pump portion for pumping liquid, said pump portion being located in said main connecting portion of said pumping member;

a pickup tube received in said holding chamber for receiving liquid, said pickup tube being operationally coupled to a first end of said pump portion;

an engagement portion for activating said pump portion, said engagement portion having a shaft extending from a second end of said pump portion, said engagement portion further having a distal engagement end with an engagement surface, said pump portion being activated when said engagement surface of said engagement portion is pushed towards said pump portion;

a spout portion extending out from a medial portion of said engagement portion, said spout portion having a spout bore in operational communication with said pump portion, said spout bore being positioned so that said liquid will fall into a hand of a user when said pump portion is activated by said hand of said user.

15. The liquid dispensing device of claim 14 wherein said pickup tube is generally U-shaped.

16. The liquid dispensing device of claim 14 wherein said distal engagement end is generally disk shaped.

17. A liquid dispensing device comprising:

a main member;

said main member having at least one holding chamber adapted for containing a liquid;

a refill connection portion for each said holding chamber, said refill connection portion being adapted to engage a container that contains a liquid, said refill connection portion extending from a top end of said main member adjacent said associated holding chamber;

each said refill connection portion having a connection bore for allowing said liquid to enter into said associated holding chamber, each said connection bore extending into said associated holding chamber;

a pumping member for each said holding chamber, said pumping member being for pumping out said liquid in said associated holding chamber, each said pumping member being in fluid communication with said liquid in said associated holding chamber, each said holding pump further being coupled to a bottom end of said main member;

a first bracket having a surface connecting portion being adapted to couple to a vertical surface, said first bracket having a pair of first arms extending out from opposite sides of said surface connecting portion along a length of said surface connecting portion, said first arms having distal first ends that curve away from said surface connecting portion; and a second bracket adapted for engaging said first bracket, said second bracket having a main connecting portion, said main connecting portion being coupled to a back side of said main member, said second bracket having a pair of second arms extending out from opposite sides of said main connecting portion along a length of said main connecting portion, said second arms having distal second ends that curve toward said main connecting portion, said distal second ends being adapted to slidably engage said distal first ends of said first bracket, said first bracket being slidably coupled to said second bracket wherein said main member is coupled to said vertical surface.

* * * * *